US007536731B1

(12) United States Patent
Feldman

(10) Patent No.: US 7,536,731 B1
(45) Date of Patent: May 26, 2009

(54) HEAD COVERING AND INSIGNIA DISPLAY ASSEMBLY

(76) Inventor: Martin Barry Feldman, 2451 Brickell Ave. #21B, Miami, FL (US) 33129

( * ) Notice: Subject to any disclaimer, the term of this patent is extended or adjusted under 35 U.S.C. 154(b) by 737 days.

(21) Appl. No.: 10/867,525

(22) Filed: Jun. 14, 2004

(51) Int. Cl.
*A42B 1/06* (2006.01)

(52) U.S. Cl. ..... 2/410; 2/425

(58) Field of Classification Search ..... 2/410, 2/411, 425, 424, 209.13, 200.1, 200.2, 171, 2/468

See application file for complete search history.

(56) References Cited

U.S. PATENT DOCUMENTS

| | | | | | |
|---|---|---|---|---|---|
| 2,140,716 | A | * | 12/1938 | Pryale | 2/414 |
| 3,242,500 | A | * | 3/1966 | Derr | 2/412 |
| 3,725,956 | A | | 4/1973 | Reisen | |
| 4,486,903 | A | | 12/1984 | Krystal | |
| 4,611,355 | A | | 9/1986 | Galanto et al. | |
| 4,667,274 | A | | 5/1987 | Daniel | |
| 4,776,043 | A | | 10/1988 | Coleman | |
| 4,873,726 | A | | 10/1989 | Tapia | |
| 5,253,368 | A | * | 10/1993 | Blake | 2/209.13 |
| 5,359,734 | A | | 11/1994 | Rathburn | |
| 5,724,681 | A | * | 3/1998 | Sykes | 2/425 |
| 5,862,523 | A | * | 1/1999 | Proctor | 2/209.11 |
| 6,401,258 | B1 | * | 6/2002 | Wilson | 2/410 |
| D478,205 | S | * | 8/2003 | Hardy | D2/896 |
| 2002/0157173 | A1 | * | 10/2002 | Murasko et al. | 2/425 |
| 2004/0250337 | A1 | * | 12/2004 | Pietrzykowski | 2/195.3 |

* cited by examiner

*Primary Examiner*—Danny Worrell
(74) *Attorney, Agent, or Firm*—Malloy & Malloy, P.A.

(57) ABSTRACT

A head covering and insignia display assembly is structured in a sports helmet configuration and includes at least one insignia representative of a sports team. More in particular, the head covering assembly is constructed of a foldable material to facilitate transport and, additionally, the foldable material is structured to be weather resistant to at least partially protect the user from the elements, such as cold and/or precipitation. The head covering and insignia display assembly may include one or more auxiliary members such as, for example, a chin strap, a neckpiece, a face mask, and/or a visor. Further, an auxiliary accessory such as an audio or visual communication device and/or an illumination device may be incorporated in a cooperative and operational association with the head covering and insignia display assembly.

33 Claims, 5 Drawing Sheets

HEAD COVERING AND INSIGNIA DISPLAY ASSEMBLY

BACKGROUND OF THE INVENTION

1. Field of the Invention

The present invention is directed to a head covering assembly having an insignia display portion on which at least one insignia representative of a sports team is affixed. More in particular, the head covering assembly comprises a sports helmet configuration and is constructed of a foldable weather resistant material. As such, the head covering assembly is a desirable item of apparel for fans of a particular sports team, especially while attending a live outdoor sporting event.

2. Description of the Related Art

Protective gear has been available to athletes participating in sporting activities for many years. In particular, protective headgear has been provided in an attempt to minimize serious and potentially fatal head injuries. As a result, a variety of helmets have been developed for persons participating in a wide range of sporting activities from bicycling to boxing to snowboarding. A number of specialized helmets have been developed for athletes participating in team contact sports such as football, hockey, lacrosse, cricket, and rugby, just to name a few. In addition, a number of specialized helmets have been developed which are utilized in other team sports, for example, a batting helmet worn by a baseball player.

As long as there have been team sports, there have also been fans of sports teams, and fans are well known to adorn themselves with, among other things, various items of apparel to show support for their sports team and/or player of choice. One such item commonly worn by fans is a standard baseball cap, as worn by baseball players in the field. Typically, these standard baseball caps include some form of insignia specific to a particular sports team such as, for example, the team color(s), logo, city, and/or name. In fact, standard baseball caps are often worn by fans of other sports, such as football and hockey, to show support for those teams, even though the players of these other sports wear rigid helmets, not baseball caps.

Among the reasons for this inconsistency in fan apparel is the fact that the rigid helmets worn by football players, hockey players, as well as certain other athletes, are not readily stored and transported to and from sporting events in the manner of the common baseball cap, which may be readily folded up and placed in the user's pocket. Further, with security concerns such as they are in today's society, facilities hosting such sporting events are not likely to condone massive numbers of fans donning protective head gear in their facility.

Among the products developed in an attempt to fill this void in a football fan's ability to emulate their favorite player and/or show support for their favorite team, is an oversized novelty football helmet constructed of a partially rigid foam material or having an inflatable configuration, and which may or may not include a face mask portion to further the effect. While these products generally comprise a shape similar to a football helmet, they are significantly oversized and may lack any indicia of any particular team, and thus, do not accurately emulate a football helmet of a favorite team. In addition, at least as to the foam embodiment, the product is even less amenable to storage and transport to and from a sporting event than an actual helmet, due to its exaggerated size. Further, the oversized nature of these products create a potential nuisance to one or more persons seated behind a fan wearing such a product at a public sporting event, which may create friction amongst the fans, a highly undesirable situation.

Lastly, such novelty headgear provides little to no protection to the user from the elements, such as the cold and rain, which may be a significant factor, particularly at sporting events played in certain open air venues during certain times of the year.

At least one device has been structured to more closely resemble an actual football helmet and includes a composite construction having a resilient elastomeric foam core over which an exterior shell of an elastic fabric is adhered. The exterior elastic fabric shell may include various team colors and/or logos printed, painted, or applied thereon by decals. This device also provides for an additional lining of fleece or other fabric mounted to the interior of the helmet-like device to provide warmth to the user. In addition, this helmet-like device may include a face and/or mouth covering to provide added warmth and which may be structured to resemble a chin strap to further the resemblance of an actual football helmet. A removable face guard constructed to a "shape stable" plastic material may be removably attached to the helmet-like device, once again, to further the resemblance to an actual football helmet. This rigid (i.e. shape stable) face guard once again creates an impediment to storage and transport to and from a sporting event of the helmet-like device, particularly in view of the fact that the elastomeric foam core does not lend itself to being readily foldable, as is a standard baseball cap.

While the foregoing device addresses some of the concerns presented by the oversized novelty helmets, several concerns remain unaddressed while new ones are presented, not the least of which is the complex, composite, and expensive structure of the foregoing helmet-like device. Thus, it is apparent that it would be beneficial to provide a head covering assembly in the configuration of a sports helmet and having an insignia display portion, wherein the assembly comprises a unitary construction of a weather resistant material structured to protect a user from the elements, such as the cold and/or precipitation. It is also apparent that a unitary construction would be preferable for such a head covering assembly so as to avoid the complexity and expense of composite construction requiring a plurality of overlying and underlying layers as is required in some known devices. It would also be preferable for the unitary weather resistant material to be readily foldable so as to facilitate storage, as well as to facilitate transport to and from a sporting event. Additionally, it would be helpful to provide a head covering assembly including a primary member which is structured to accommodate the removable attachment of one or more auxiliary members, each being structured to further protect the user from the elements.

SUMMARY OF THE INVENTION

The present invention is directed to a head covering and insignia display assembly including a primary member constructed of a foldable weather resistant material and structured to comprise a sports helmet configuration. Additionally, the primary member comprises a unitary construction so as to eliminate the complex and expensive composite construction requirements associated with known devices. In one embodiment, the primary member comprises a unitary construction of fleece, or another readily foldable material including, for example, leather, flannel, or wool, just to name a few, to provide the user with at least some degree of protection from the elements, such as cold temperatures. In one other embodiment, the primary member comprises a unitary construction of vinyl or another readily foldable material structured to protect the user from precipitation such as HYTREL, which is a thermoplastic polyester elastomer or GORE-TEX, which is a waterproof, breathable fabric used in garments and footwear, once again, by way of example only.

The primary member of the present invention is structured to be disposed in an operative position on a user's head. More in particular, the primary member is structured to be disposed in an overlying relation with the user's head so as to at least partially protect the user's head from the elements, the overlying relation at least partially defining the operative position.

As noted above, the present head covering assembly, and more specifically, the primary member, includes an insignia display portion. The insignia display portion of the present invention is structured such that at least one primary insignia is affixed thereto, the primary insignia may be representative of a particular sports team. For example, the primary insignia may include a team's color(s), logo, name, and/or city, just to name a few. In addition, one embodiment of the present invention may also include a secondary insignia such as, for example, a stripe, a player's number, and/or a manufacturer's logo.

In addition to the primary member as described above, the present invention may include at least one auxiliary member attached to said primary member, for example, as by stitching. In at least one embodiment, the auxiliary member is removably attached to the primary member. For example, in one embodiment, the auxiliary member may comprise a chin strap structured to maintain the primary member in an operative position on the user's head. Alternatively, or in addition to a chin strap, the auxiliary member may include a face mask or a neckpiece structured to further protect the user from the elements, such as cold and/or precipitation. Yet one other embodiment may comprise a visor as an auxiliary member, once again, to further protect the user from the elements.

To facilitate the aforementioned removable attachment, one embodiment of the head covering assembly of the present invention comprises an attachment mechanism structured to allow one or more auxiliary members to be removably attached to at least a portion of the primary member. In at least one embodiment, the attachment mechanism comprises a portion of a hook and loop type fastener affixed to corresponding portions of the primary member and one or more auxiliary members.

A further embodiment of the head covering and insignia display assembly of the present invention may incorporate an auxiliary accessory such as, by way of example only, an audio communication device, a visual communication device, and/or an illumination device. In such an embodiment, the auxiliary accessory is structured and disposed in a cooperative and operational association with the primary member, and such that the auxiliary accessory is non-intrusive to the user and/or persons proximate to the user.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As indicated above, the present invention is directed to a head covering and insignia display assembly, generally as shown at 10 throughout the figures, the assembly 10 being a desirable item of attire which allows a fan of a particular sports team to show support for the team of their choice, and at least partially protecting the fan from the elements, such as the cold, rain, and snow, such as while attending a live sporting event.

To begin, the head covering and insignia display assembly 10 of the present invention includes a primary member 11, the primary member 11 comprising a foldable weather resistant material. For example, the primary member 11 may comprise fleece, a foldable weather resistant material commonly utilized in articles of clothing structured to protect a person from at least cold temperatures. Among the numerous varieties of fleece which may be utilized in the present invention are arctic fleece, polar fleece, micro fleece, and mission fleece, just to name a few. A few other foldable weather resistant materials which the primary member 11 of the present invention may comprise include leather, flannel, wool, tricot, as well as other materials such as THINSOLATE, a synthetic fiber material used for insulation in clothing, once again, each of these materials being structured to at least protect from cold temperatures.

In addition to protection from the cold, the primary member 11 of the present invention may comprise a foldable weather resistant material structured to protect the user from precipitation, such as the rain and snow. In particular, the primary member 11 may comprise one of the numerous vinyl-based materials, or one of the specialty synthetic materials, including the materials commonly known as HYTREL, GORE-TEX or STORM-FIT, a water resistant garment material, such as are structured to protect the user from precipitation.

In one preferred embodiment, the primary member 11 of the present invention comprises a unitary construction of the foldable weather resistant material. More in particular, the primary member 11 is constructed of a single selected material, whether it be, by way of example only, fleece, flannel, wool, or any of the synthetic materials noted above. In one preferred embodiment, the primary member comprises a unitary foldable weather resistant material panel. As such, the present invention improves greatly upon the known devices constructed via a complex process of joining together a plurality of layers of different materials.

Figure 5:
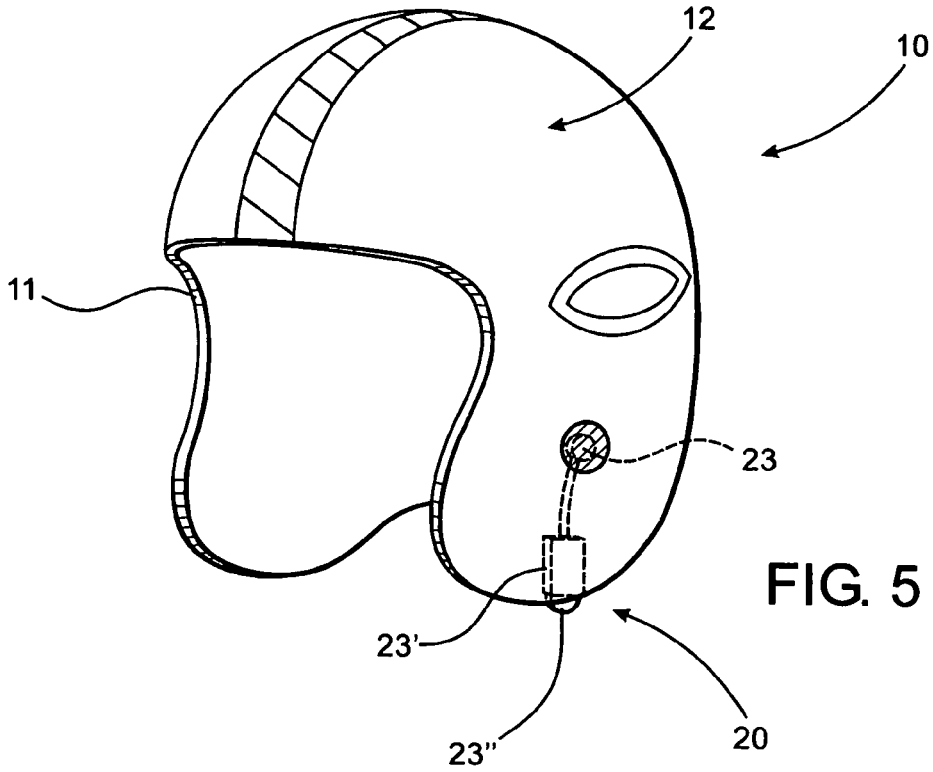
FIG. 5 is a perspective view of another embodiment of the present invention further illustrating an audio communication device.
Figure 6:
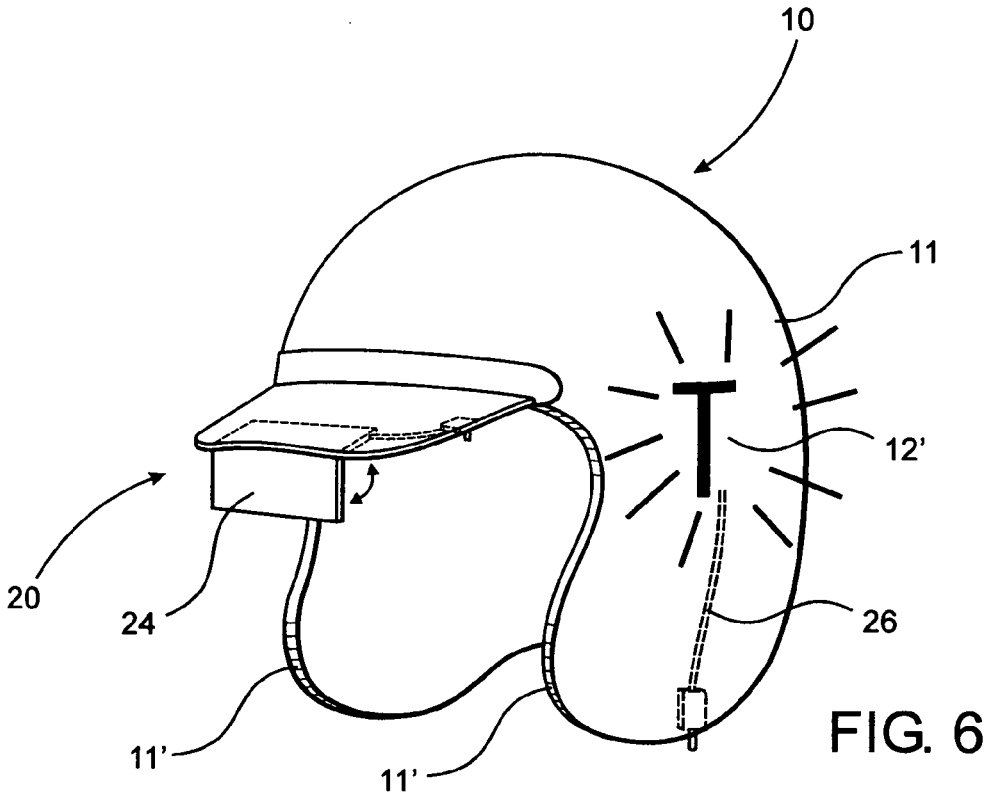
FIG. 6 is a perspective view of yet one other embodiment of the present invention illustrating a visual communication device and an illumination device.
Figure 7:
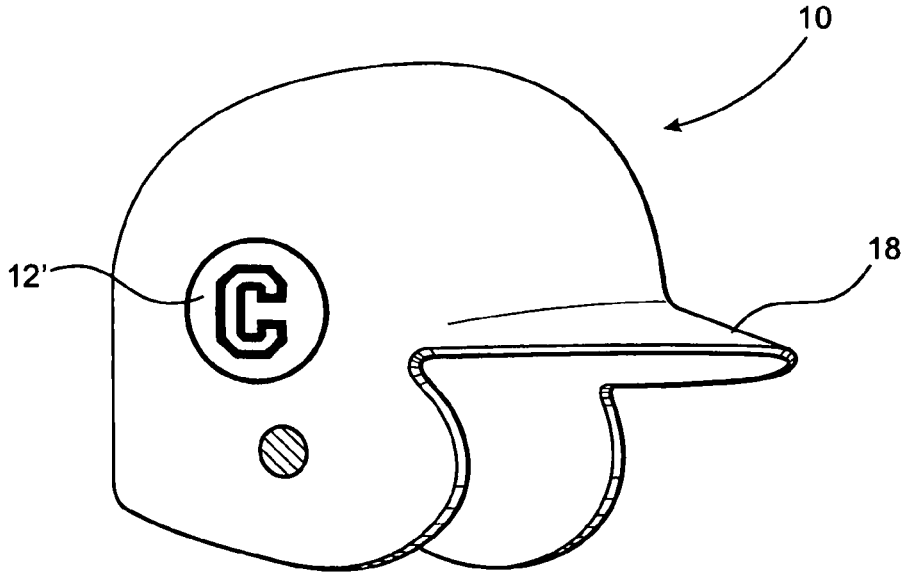
FIG. 7 is a perspective view one other preferred embodiment of the head covering and insignia display assembly of the present invention.
Figure 8:
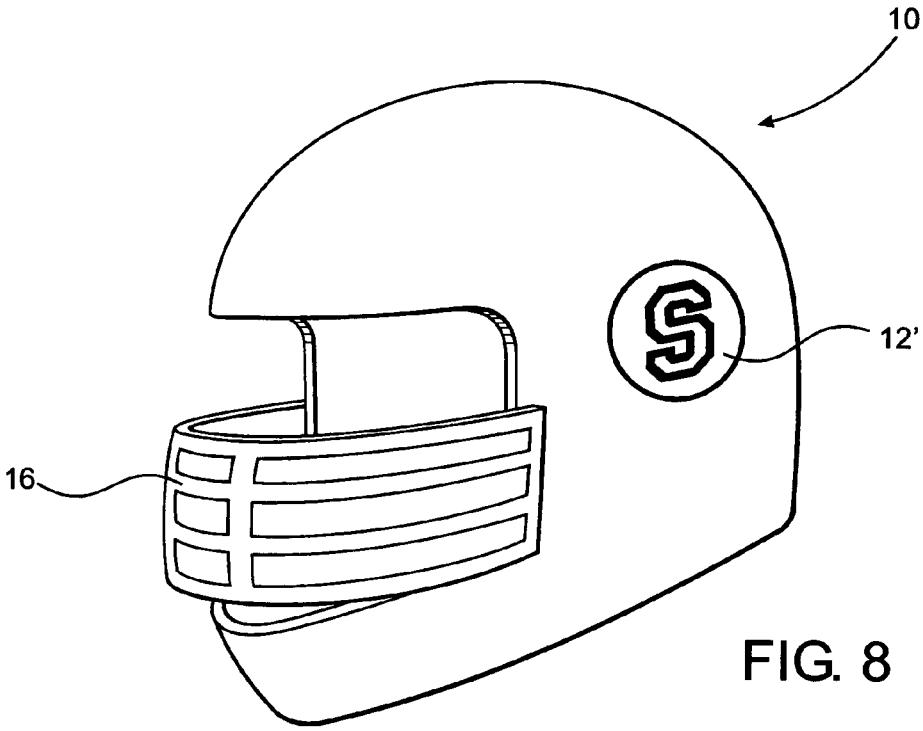
FIG. 8 is an elevation of yet another embodiment of the head covering and insignia display assembly of the present invention.
Figure 9:
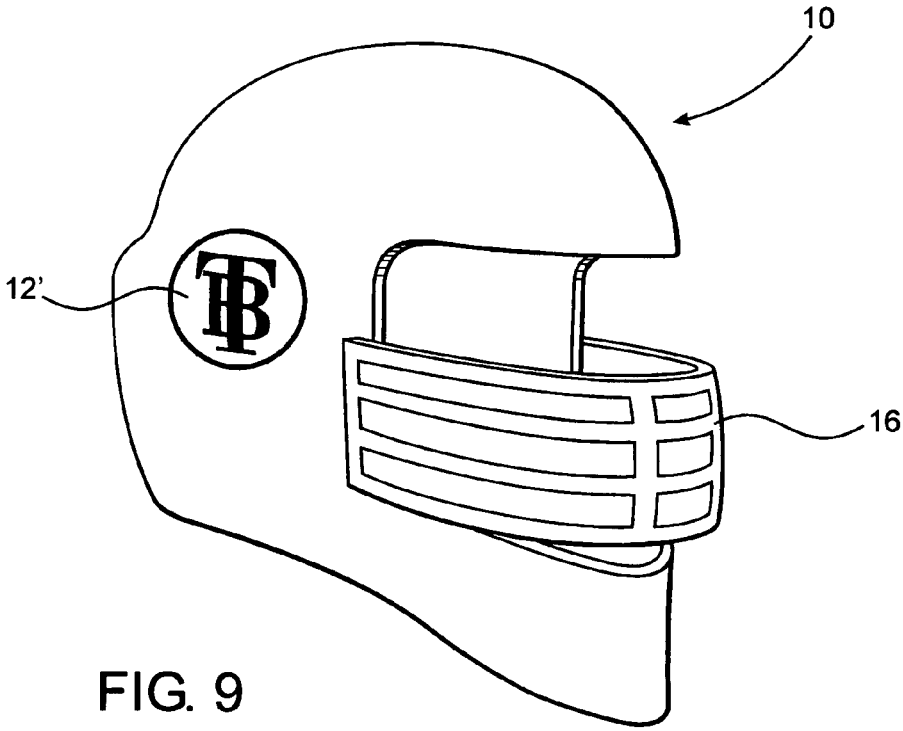
FIG. 9 is an elevation of one further embodiment of the head covering and insignia display assembly of the present invention.

Additionally, the primary member 11 is constructed so as to comprise a sports helmet configuration and in particular, in one preferred embodiment, the primary member 11 is structured to comprise a football helmet configuration, as illustrated in FIGS. 1 through 6. More specifically, the unitary foldable weather resistant material panel defines a front portion which is structured to permit the users face to be exposed and a back portion which is structured to at least partially cover the users ears and neck. It is understood to be within the scope and intent of the present invention for the primary member 11 to comprise the configuration of other types of sports helmets as well, such as, by way of example only, a batting helmet, as illustrated in FIG. 7, a lacrosse helmet, as illustrated in FIG. 8, a hockey helmet, such as a goalie mask, as illustrated in FIG. 9, a rugby helmet, etc.

As noted above, the primary member 11 of the present invention is further structured to be disposed in an operative position on a user's head. More in particular, the primary member 11 is structured to be disposed in an overlying relation with the user's head so as to at least partially protect the user's head from the elements, the overlying relation thus at least partially defining the operative position. In one preferred embodiment, the primary member 11 is structured to comprise a sports helmet configuration, as illustrated throughout the figures, and as such, the primary member 11 includes lower portions 11', as shown in FIG. 6, structured to be disposed in an overlying relation with the user's ears. As such, the operative position of the primary element 11 is further defined by the lower portion 11' being disposed in such an overlying relation with the user's ears, thereby at least partially protecting the user's ears from the elements.

The primary member 11 of the present invention further comprises an insignia display portion 12. The insignia display portion 12 is disposed on the outer surface of the primary member 11 such that it is readily visible to persons proximate to the user, when the primary member 11 is disposed in the operative position on the user's head. In at least one embodiment, the insignia display portion 12 comprises substantially the entire outer surface of the primary member 11. More in particular, the insignia display portion 12 is structured and disposed such that at least one primary insignia 12' may be affixed thereto. The primary insignia 12' may include, but is not limited to, a team's color(s), for example, the distinctive orange coloration of a Cleveland Browns player's helmet, a team logo, a team name, a city, and/or a country, just to name a few. In one preferred embodiment, the insignia display portion 12 is structured and disposed such that a plurality of primary insignia 12' may be affixed thereto, such as, by way of example only, a pair of team logos affixed to the display portion 12, wherein each logo is disposed on an opposite side of the primary member 11, as illustrated in part in FIG. 4.

Figure 2:
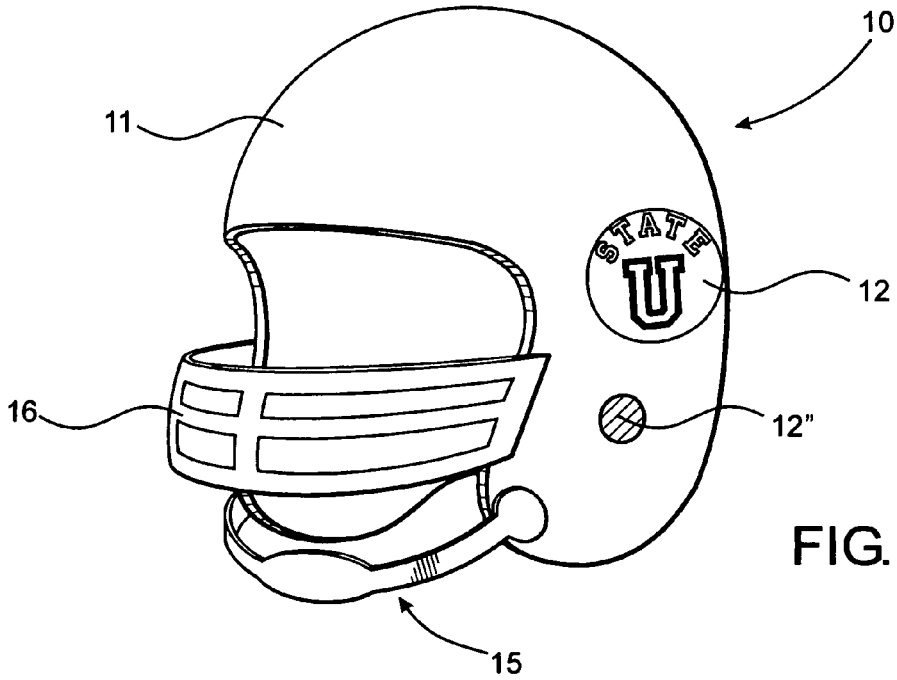
FIG. 2 is a perspective view of the embodiment of FIG. 1 further illustrating a face mask in accordance with the present invention.

A further embodiment of the head covering and insignia display assembly 10 of the present invention comprises at least one secondary insignia 12" also affixed to the insignia display portion 12. The secondary insignia 12" may include, but is in no manner limited to, one or more stripes, a player's number, or a manufacturer's logo, once again, just to name a few. As illustrated in FIG. 2, the secondary insignia 12", may comprise a representation of an ear hole, to further the appearance of an actual football helmet. As in the case of the primary insignia 12', the insignia display portion 12 of the present invention is structured and disposed such that a plurality of secondary insignia 12" may be affixed thereto.

Any one of a number of techniques may be employed to affix the primary insignia 12' and/or the secondary insignia 12" to the insignia display portion 12 of the primary member 11 of the present invention. For example, the primary insignia 12' may be a patch including a team logo, wherein the patch may or may not comprise the same material as the primary member 11, and wherein the patch is affixed to the insignia display portion 12 by stitching or adhesive. Alternatively, one or more primary insignia 12' and/or secondary insignia 12" may be affixed to the insignia display portion 12 by dying, printing, airbrushing, or heat transferring from a release sheet directly onto the insignia display portion 12, as is common for applying an image to a tee shirt. It is to be understood that the particular technique employed to affix one or more primary insignia 12' and/or secondary insignia 12" is not a limiting feature of the present invention and that additional techniques may be employed to affix one or more insignia based upon the complexity or lack thereof of any particular insignia.

At least one embodiment of the head covering and insignia display assembly 10 of the present invention further comprises at least one auxiliary member 14, the auxiliary member 14 being structured to provide further protection to the user from the elements. The auxiliary member 14 of the present invention is structured to be attached to the primary member 11 via an attachment mechanism 13. In one preferred embodiment, the attachment mechanism 13 is structured such that an auxiliary member 14 may be removably attached to the primary member 11. In this preferred embodiment, the attachment mechanism may comprises a hook and loop type fastener, a portion of the hook and loop type fastener being affixed to a corresponding portion of each of the primary member 11 and the secondary member 14, as illustrated best in FIG. 1 and FIG. 3.

Alternatively, the attachment mechanism 14 may comprise a zipper, buttons, snaps, ties, etc., as are known for use in removably attaching articles of clothing to facilitate donning by a person.

Figure 1:
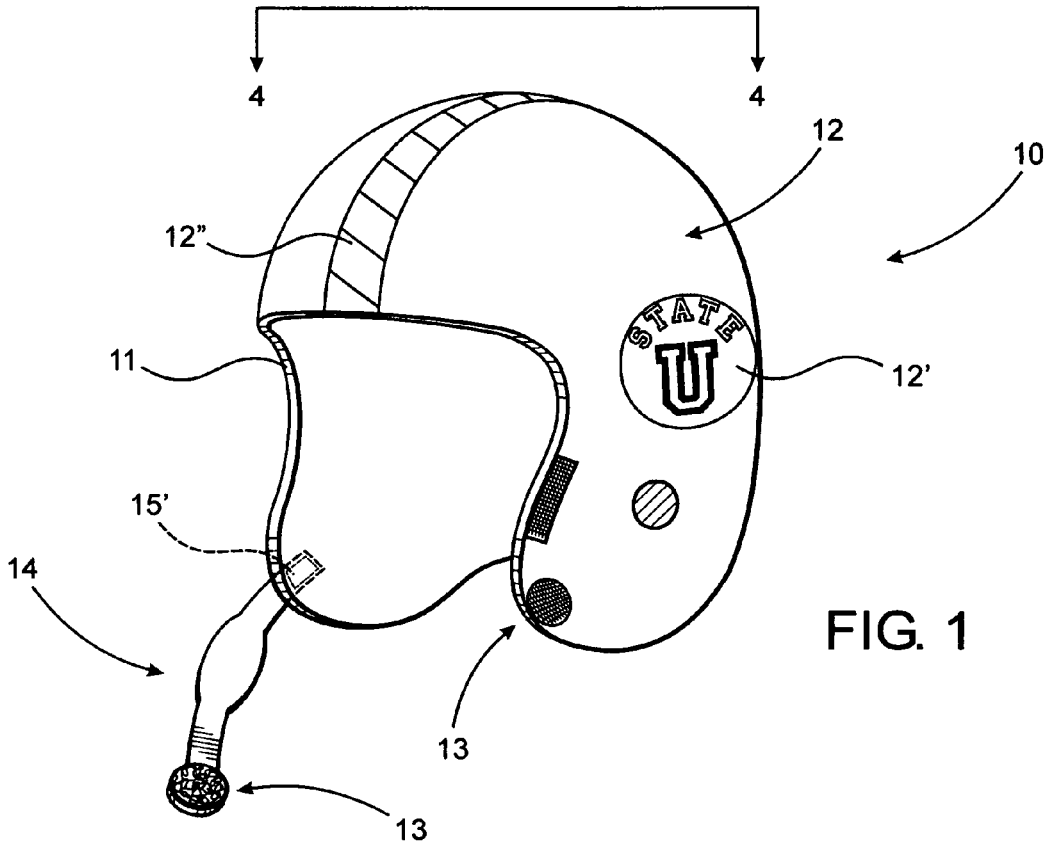
FIG. 1 is a perspective view of one preferred embodiment of the head covering and insignia display assembly of the present invention.

In one preferred embodiment, the auxiliary member 14 comprises a chin strap 15, as illustrated in FIG. 1 and FIG. 2, the chin strap 15 being structured to at least temporarily maintain the primary member 11 of the present invention in an operative position on the user's head. In at least one embodiment, at least a portion of the chin strap 15 may be securely attached to the primary member 11 such as by stitching or adhesive, such as the attached end of the chin strap 15' shown in FIG. 1.

Figure 3:
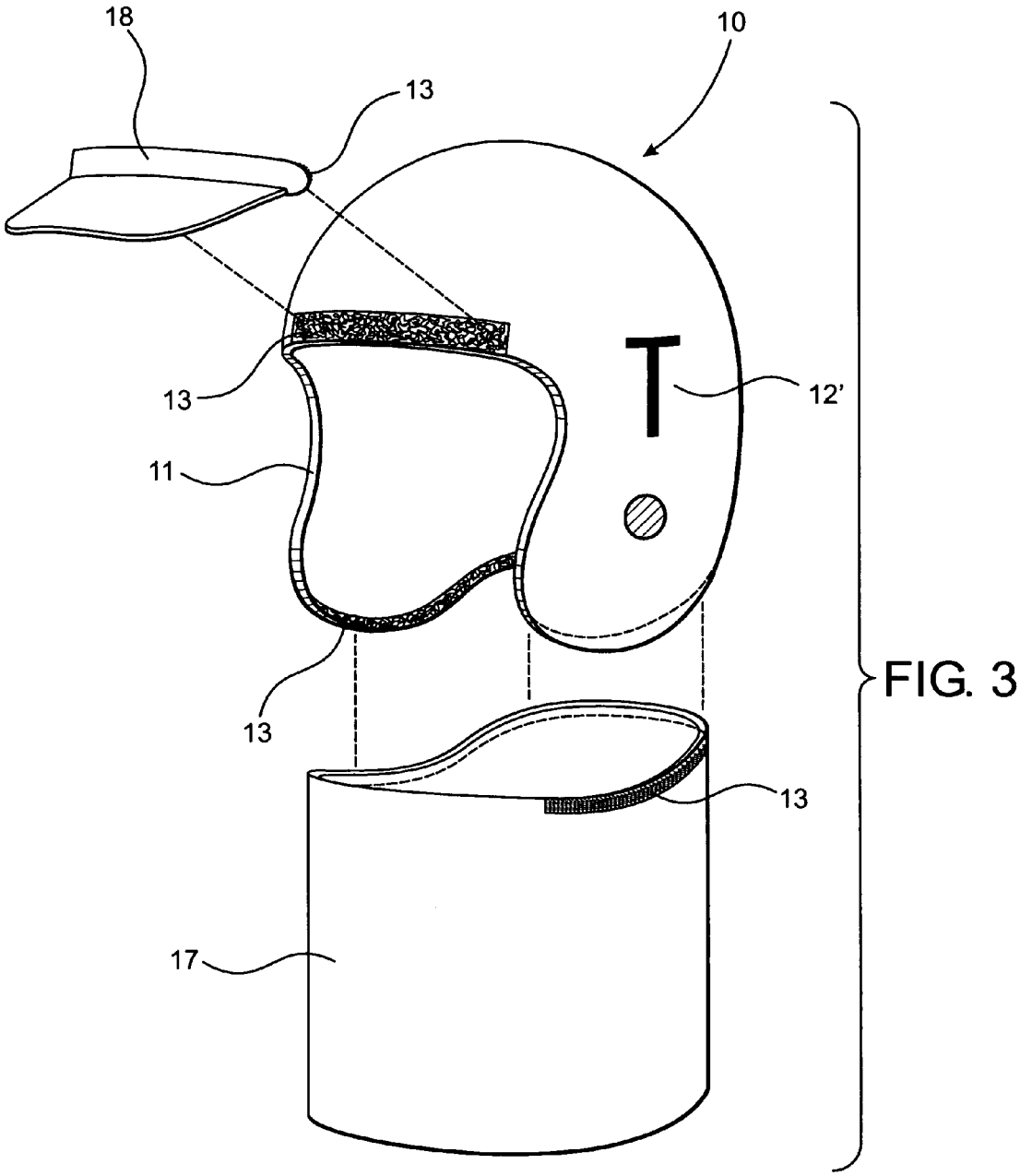
FIG. 3 is a partially exploded perspective view of one other preferred embodiment of the head covering and insignia display assembly of the present invention illustrating a neckpiece and a visor.
Figure 4:
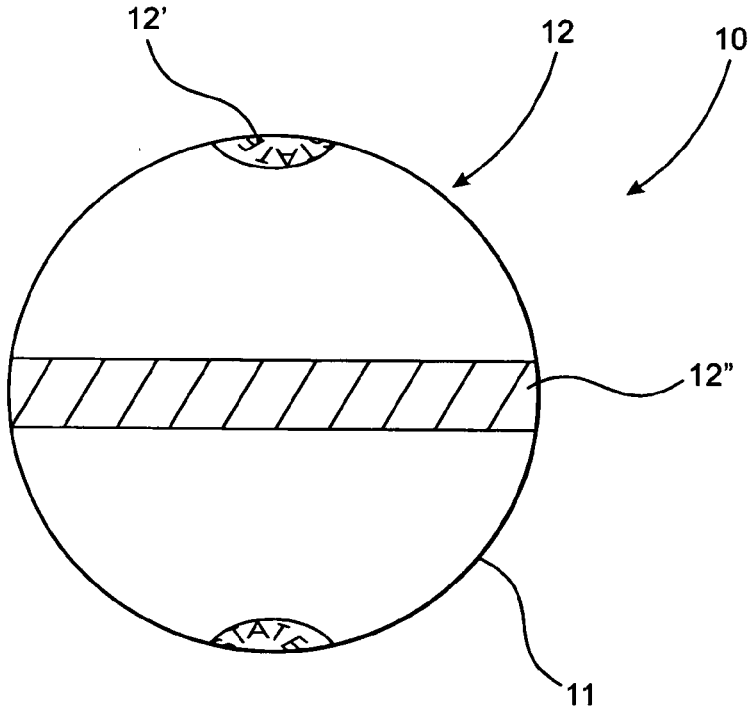
FIG. 4 is a plan view of the embodiment of FIG. 1 along lines 4-4 thereof.

In one other embodiment, the head covering and insignia display assembly 10 of the present invention may comprise a plurality of auxiliary members 14, as illustrated in FIG. 2 and FIG. 3. For example, the head covering and insignia display assembly 10 may comprise a chin strap 15, as described above, as well as a face mask 16. The face mask 16, in one preferred embodiment, also comprising a foldable weather resistant material, which is preferably a breathable material so as to allow the user to breathe easily through the face mask 16 while disposed in an operative position, as illustrated in FIG. 2. In at least one embodiment, the face mask 16 may include a pattern designed to resemble a face guard of an actual football helmet, as also illustrated in FIG. 2. In one further embodiment, the face mask comprises a foldable and flexible material structured to fit snugly over the users mouth and nose while disposed in an operative position.

In one further preferred embodiment, the auxiliary member 14 of the head covering and insignia display assembly 10 of the present invention comprises a neckpiece 17, as illustrated in FIG. 3. The neckpiece 17, in at least one embodiment, also comprises a unitary construction of a foldable weather resistant material, the foldable weather resistant material preferably being stretchable, so as to facilitate positioning the neckpiece 17 in an operative position around the neck of the user. Once again, the operative position being at least partially defined by an overlying relationship so as to protect the user from the elements, specifically, the neckpiece 17 being disposed in an overlying relationship with the user's neck, thereby at least partially protecting the user's neck from the elements. In at least one embodiment, the face mask 16 may be an integral component of the neckpiece 17.

Further, in one preferred embodiment, the neckpiece 17 is structured to cooperatively associate with the primary member 11 such that the neckpiece 17 is disposed in a complimentary relationship with the sports helmet configuration. More specifically, the neckpiece 17 and its corresponding attachment mechanism 13 are structured so as not to detract from the appearance of the sports helmet configuration when disposed in an operative position relative to the primary member 11. This cooperative association may be accomplished via the shape of the neckpiece 17 at its interface with the primary member 11 and/or via a neutral coloration of the neckpiece 17 so as to belie its presence while disposed in cooperative association with the primary member 11, as illustrated in FIG. 3. In at least one embodiment, the neckpiece 17 may comprise a coloration similar to the primary member 11.

The auxiliary member 14 of the present invention may comprise a visor 18, as illustrated in FIG. 3 and FIG. 6, the visor 18 being structured to be removably attached to the primary member 11 and further structured to at least partially protect the user's eyes from the elements, such as the wind, rain, snow, as well as bright sunlight, while disposed in an operative position relative to the primary member 11. In one preferred embodiment, the visor 18 is constructed of a foldable weather resistant material comprising a unitary construction. In at least one alternate embodiment, the visor 18 may be constructed of a semi-rigid translucent plastic material, as are common on a variety of sports caps which include a visor 18.

In at least one embodiment, the head covering and insignia display assembly 10 of the present invention comprises at least one auxiliary accessory, generally as shown at 20, disposed in a cooperative and operational association with the primary member 11. The cooperative and operational association of the auxiliary accessory 20 is at least partially defined by the auxiliary assembly 20 being disposed such that an operative portion is mounted to the primary member 11, the operative portion being actuable into an operating mode relative to the user. For example, the auxiliary accessory 20 may comprise an audio communication device, such as an earpiece 23 interconnected to a radio, which is particularly desirable for sports fans who may wish to listen to a sports broadcast while attending a sporting event. In one preferred embodiment, the audio communication device may comprise an entire radio mounted to the primary member 11 which, as illustrated in FIG. 5, includes an earpiece 23, tuner 23', having a switch 23" to allow the user to turn the radio on and off as desired. In one alternate embodiment, the audio communication device may comprise a 'hands free' headset which is structured to be interconnected to a cellular communication device which the user stores elsewhere on his or her person.

In one other embodiment, the auxiliary accessory 20 may comprise a visual communication device 24, such as a video monitor, to permit the user to view visual programming while disposed in a viewing orientation. As illustrated in FIG. 6, the visual communication device 24 may be mounted to the visor 18, such that the video monitor may be rotated in and out of a viewing orientation relative to the user. Also as illustrated in FIG. 6, the auxiliary accessory 20 may comprise one or more illumination device 26 which, in at least one embodiment, is utilized to illuminate at least a primary insignia 12'.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A head covering and insignia display assembly comprising:

a primary member structured to be disposed in an operative position on a user's head, said primary member comprising a unitary, one piece construction of a single, foldable, weather resistant material dimensioned to facilitate storage and transport of said primary member when in a folded orientation, said primary member structured to comprise a sports helmet configuration, said primary member further comprising an insignia display portion integrated into said primary member and defined by at least a portion of an outer surface thereof, and at least one primary insignia affixed onto said insignia display portion.

2. The assembly as recited in claim 1 wherein said primary insignia comprises a team color.

3. The assembly as recited in claim 1 wherein said primary insignia comprises a team logo.

4. The assembly as recited in claim 1 further comprising at least one secondary insignia affixed onto said insignia display portion.

5. The assembly as recited in 4 wherein said secondary insignia comprises at least one stripe.

6. The assembly as recited in claim 1 wherein said primary insignia is affixed onto said insignia display portion via printing.

7. The assembly as recited in claim 1 wherein said primary insignia is affixed onto said insignia display portion via dyeing.

8. The assembly as recited in claim 1 wherein said primary insignia is affixed onto said insignia display portion via stitching.

9. The assembly as recited in claim 1 wherein said primary insignia is affixed onto said insignia display portion via heat transfer.

10. The assembly as recited in claim 1 wherein said primary insignia is affixed onto said insignia display portion via airbrushing.

11. The assembly as recited in claim 1 wherein said foldable weather resistant material comprises an insulating material.

12. The assembly of claim 11 wherein said insulating material comprises fleece.

13. The assembly of claim 11 wherein said insulating material comprises leather.

14. The assembly of claim 11 wherein said insulating material comprises wool.

15. The assembly of claim 11 wherein said insulating material comprises flannel.

16. The assembly as recited in claim 1 wherein said one piece construction of a foldable, weather resistant material further comprises a water resistant material.

17. The assembly as recited in claim 16 wherein said water resistant material comprises vinyl.

18. The assembly as recited in claim 16 wherein said water resistant material comprises a thermoplastic polyester elastomer.

19. The assembly as recited in claim 1 further comprising at least one auxiliary member structured to be removably attached to said primary member, said one auxiliary member formed of a one piece foldable, weather resistant material.

20. The assembly as recited in claim 19 wherein said one piece, foldable, weather resistant material is dimensioned to facilitate transport and storage of said one auxiliary member.

21. A head covering and insignia display assembly comprising:

a primary member constructed of a one piece construction of a single, foldable, weather resistant material and structured to comprise a sports helmet configuration, said primary member further structured to be disposed in an operative position on a user's head, said operative position at least partially defined by said primary member disposed in an overlying relation with the user's head so as to partially protect the user's head from the elements, said primary member comprising an insignia display portion integrated into said primary member and defined by at least a portion of an outer surface thereof, at least one primary insignia affixed onto said insignia display portion, at least one auxiliary member structured to be removably attached to said primary member, and an attachment mechanism structured to facilitate said removable attachment between said auxiliary member and said primary member.

22. The assembly as recited in claim 21 wherein said attachment mechanism comprises a hook and loop type fastener, a portion of said hook and loop type fastener being disposed on each of said auxiliary member and said primary member and cooperatively associating to facilitate removable attachment of said auxiliary member and said primary member.

23. The assembly as recited in claim 21 wherein said auxiliary member comprises a neckpiece, said neckpiece structured to be disposed in an overlying position with the user's neck so as to partially protect the user's neck from the elements.

24. The assembly as recited in claim 23 wherein said neckpiece cooperatively associates with said primary member in a complimentary relationship with said sports helmet configuration.

25. The system as recited in claim 24 wherein said neckpiece comprises a unitary, one piece construction of a stretchable, water and weather resistant material.

26. The assembly as recited in claim 21 wherein said auxiliary member comprises a chin strap, said chin strap structured to at least temporarily maintain said primary member in said operative position on the user's head.

27. The assembly as recited in claim 21 wherein said auxiliary member comprises a face mask, said face mask structured to at least partially cover the user's face when disposed in an operative position, so as to partially protect the user's face from the elements.

28. The assembly as recited in claim 21 wherein said auxiliary member comprises a visor, said visor structured to partially protect the user's eyes from the elements.

29. The assembly as recited in claim 21 wherein said operative position is further defined by a lower portion of said primary member disposed in an overlying relation with the user's ears, so as to partially protect the user's ears from the elements.

30. A head covering and insignia display assembly comprising:

a primary member structured to be disposed in an operative position on a user's head, said primary member comprising a unitary, one piece construction of a single weather resistant material, said primary member structured to comprise a sports helmet configuration, said primary member further comprising an insignia display portion integrated into said primary member and defined by at least a portion of an outer surface thereof, at least one primary insignia affixed onto said insignia display portion, at least one auxiliary member formed of a one piece foldable weather resistant material and structured to be removably attached to said primary member, an attachment mechanism structured to facilitate said removable attachment between said at least one auxiliary member and said primary member, and at least one auxiliary accessory disposed in a cooperative and operational association with said primary member.

31. The system as recited in claim 30 wherein said auxiliary accessory comprises an audio communication device.

32. The system as recited in claim 30 wherein said auxiliary accessory comprises a visual communication device.

33. The system as recited in claim 30 wherein said auxiliary accessory comprises an illumination device.

* * * * *